United States Patent [19]

Outram et al.

[11] 4,095,389

[45] Jun. 20, 1978

[54] JOINED CONCRETE BODIES AND METHOD OF JOINING SAME

[75] Inventors: Christopher David Outram, London; Hugh Jeremy Willis Edwards, Menston, both of England

[73] Assignee: CCL Systems Limited, England

[21] Appl. No.: 788,203

[22] Filed: Apr. 18, 1977

[30] Foreign Application Priority Data

Apr. 20, 1976 United Kingdom ..... 15826/76

[51] Int. Cl.[2] ..... E04C 1/10; E04C 1/30

[52] U.S. Cl. ..... 52/583; 29/460; 29/469.5; 29/517; 29/526 R; 52/587; 52/726; 403/268

[58] Field of Search ..... 29/452, 460, 517, 469.5, 29/526; 403/268, 274, 406; 52/259, 583, 587, 726, 722

[56] References Cited

U.S. PATENT DOCUMENTS

| | | | |
|---|---|---|---|
| 688,513 | 12/1901 | Hammond | 403/274 |
| 3,089,215 | 5/1963 | Stubbs | 52/223 R X |
| 3,255,498 | 6/1966 | Leuthy et al. | 52/726 UX |
| 3,551,999 | 1/1971 | Gutmann | 29/517 |
| 3,552,787 | 1/1971 | Yee | 52/722 X |
| 3,638,978 | 2/1972 | Guntermann | 403/268 X |
| 3,861,811 | 1/1975 | Mason et al. | 403/274 X |

FOREIGN PATENT DOCUMENTS

| | | | |
|---|---|---|---|
| 264,091 | 8/1968 | Austria | 52/587 |
| 2,124,433 | 12/1972 | Germany | 52/583 |
| 2,205,772 | 8/1973 | Germany | 52/726 |

*Primary Examiner*—Charlie T. Moon

*Attorney, Agent, or Firm*—Caesar, Rivise, Bernstein & Cohen, Ltd.

[57] ABSTRACT

A method of joining together two concrete bodies each having a concrete reinforcing bar, the method involving compressing a gripping portion of a metal sleeve on the end of the first bar with the metal sleeve also having an unpressed portion which extends beyond the bar, the unpressed portion having an internal diameter larger than the maximum cross-sectional dimension of the second of the bars, and securing an end of the second of the bars within the unpressed portion of the sleeve by means of a self-setting composition.

10 Claims, 5 Drawing Figures

JOINED CONCRETE BODIES AND METHOD OF JOINING SAME

This invention relates to the joining together of two bodies of concrete by uniting the reinforcing bars contained in the bodies.

A method of joining together two bodies of concrete, each body having therein or therethrough a concrete-reinforcing bar, comprises, according to the invention, compressing on to an end of one of the bars a gripping portion of a metal sleeve so as to cause the gripping portion tightly to grip the bar, the sleeve also having an unpressed portion which when the gripping portion grips the bar extends beyond the end of the bar, the unpressed portion having an internal diameter larger than the maximum cross-sectional dimension of the other of the bars, and securing an end of the second of the bars within the unpressed portion of the sleeve by means of a self-setting composition.

The gripping portion of the sleeve may be compressed on to the one bar before the respective body of concrete is cast about that bar and is preferably arranged so that, after casting of the concrete body, the sleeve opens at the adjacent face of the body.

The two portions of the sleeve may be releasably secured together, preferably having co-operable screw threads to enable the portions to be secured together. A preferred method according to the invention may then comprise aligning the end of the second bar with the end of the first bar having the gripping portion of the sleeve compressed thereon, securing the unpressed portion to the gripping portion, the bars and the portions of the sleeve being arranged such that the unpressed portion surrounds the end portion of the second bar, inserting a self-setting composition into the unpressed portion, and allowing the composition to set to secure the bar therein. This method is particularly useful where the concrete bodies are very heavy and alignment of the bars by moving the bodies is thus difficult or impossible.

Where a screw connection is to be used between the gripping and unpressed portions of the sleeve, the gripping portion preferably has an external screw thread at one end and the unpressed portion has a corresponding internal screw thread. It is preferred to provide the screw thread on the gripping portion before it is pressed on to the bar, and in such a case the gripping portion can only be pressed over its unthreaded length.

An alternative preferred method according to the invention uses a one-piece sleeve which is pressed on the first bar such that the unpressed portion of the sleeve projects beyond the end of the bar. One-piece sleeves are of particular use where the concrete bodies may readily be drawn together.

Preferably the unpressed portion of the sleeve is provided with internal deformations which form a key for the self-setting composition. The self-setting composition may be a high strength cementitious or resinous grout of the type which will not shrink appreciably. Where the axes of the bars to be joined lie in the horizontal plain, the self-setting compostion is preferably pastey or thixotropic.

The invention is particularly applicable to bodies of concrete reinforced with reinforcing bars having ribs or other deformations which serve to improve the adhesion of the bar to the concrete. Such ribs or deformations are typically in the form of a broken spiral rib forming a screw thread, or two opposed longitudinal ribs and regularly spaced circumferential ribs. Bars formed by cold twisting of a chamfered square bar so as to form a generally spiral configuration may also be used with the method of the invention.

In the method of the invention it is possible to use parts which are not manufactured to the extremely high tolerances required in placing reinforcing bars in concrete structures when intending to join bars by splicing a sleeve to both of them. Further, when splicing both bars by known methods there may be a tendency for the bodies to move slightly apart, which does not occur when the bodies are joined using the method of the invention.

The invention includes a product of the method, two bodies of concrete, each body having therein or therethrough a concrete-reinforcing bar, joined together by means of a metal sleeve having a gripping portion and an unpressed portion, the gripping portion being compressed on to the end of one of the bars so as to grip the bar tightly, the unpressed portion extending beyond the end of the bar and having an internal diameter larger than the maximum cross-sectional dimension of the other of the bars, the end of the other bar being secured within the unpressed portion of the sleeve by means of a set self-setting composition.

Preferred embodiments of the invention are described with reference to the accompanying diagrammatic drawings, in which.

Figure 1:
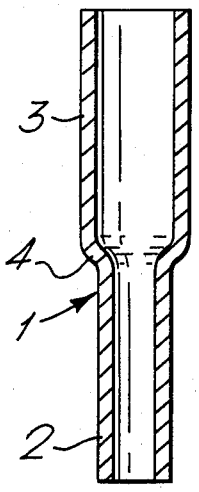
FIG. 1 shows one form of sleeve before it is pressed on to a reinforcing bar.
Figure 2:
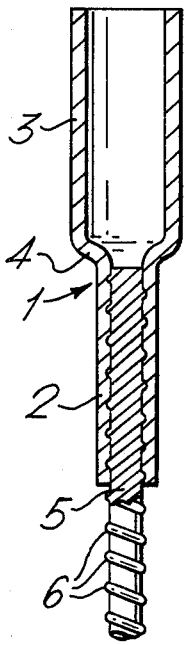
FIG. 2 shows the same sleeve pressed on to a reinforcing bar.

The sleeve 1 of FIGS. 1 and 2 is formed of a seamless steel tube which has been shaped into two portions, a gripping portion 2 and an unpressed, grout-receiving portion 3, the gripping portion 2 having a smaller diameter than the unpressed portion 3. The two portions 2 and 3 are joined by an integral neck portion 4. As shown in FIG. 2, the gripping portion 2 of the sleeve 1 is pressed on to an end portion of a reinforcing bar 5 so as to leave the neck portion 4 and the unpressed portion 3 projecting beyond the end of the bar 5. The bar has ribs 6 which aid anchorage in a concrete body.

Figure 3:
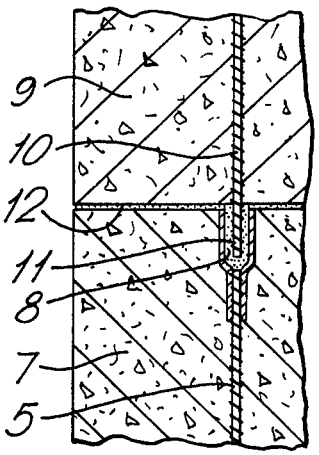
FIG. 3 shows a sectional view of two blocks of concrete joined by the sleeve of FIGS. 1 and 2.

As shown in FIG. 3, the bar 5 may be cast in a first block of concrete 7 such that the mouth of the unpressed portion 3 lies at a face of the block, for example the upper face as shown. A cementitious grout 8 is poured or otherwise inserted into the unpressed portion 3 and then a second block of concrete 9 having a reinforcing bar 10, an end portion 11 of which projects beyond the lower face 12 of the second block 9, is lowered on to the first block 7 so as to direct the end portion 11 into the unpressed portion 3. In the condition shown, the grout flows to seal the gap between the blocks. The grout then sets so locking the bar 10 inside the sleeve and joining the two blocks 7 and 9 together.

Although FIG. 3 shows the sleeve 1 set flush with the face of the first block 7, the sleeve may be completely or partially outside the block, the gap between the two blocks being filled with concrete after the joint is made.

Figure 4:
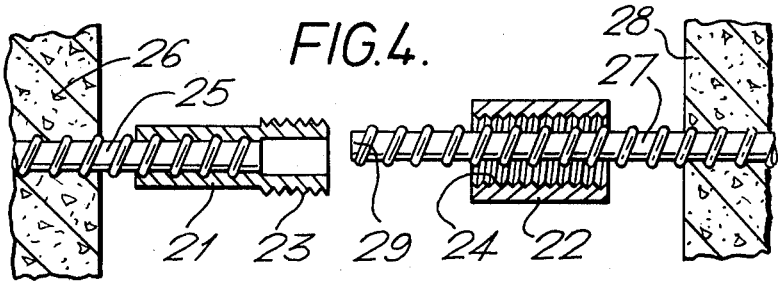
FIG. 4 shows a sectional view of two blocks of concrete having reinforcing bars which are to be joined by a second form of sleeve.
Figure 5:
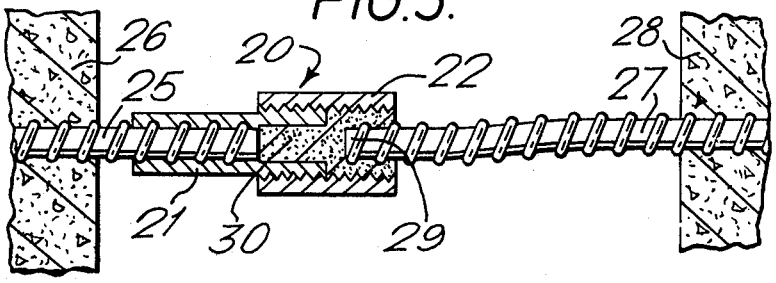
FIG. 5 shows, in sectional view the blocks shown in FIG. 4, after joining.

A form of joint using a two-part sleeve is shown in FIGS. 4 and 5. The two-part sleeve has a gripping portion 21 and an unpressed portion 22 of relatively wider bore, the unpressed portion 22 being detachably engageable upon the gripping portion 21 by means of co-operable screw threads 23 and 24 on the two portions. The gripping portion 21 is pressed, for example by an hydraulic swaging press, on to a reinforcing bar 25 protruding from one face of a first block of concrete 26. A second reinforcing bar 27 projects from a face of a second block of concrete 28 opposite the first, and as shown may be slightly out of alignment with the first bar 25. Where the blocks 26 and 28 cannot readily be moved to align the bars 25 and 27, for example where they are particularly heavy, the second reinforcing bar 27 is bent so that at least its free end 29 is in alignment with the first bar 25. If preferred, however, both bars may be bent into alignment with one another. The internally threaded unpressed portion 22, previously placed around the other bar 27, is screwed on to the gripping portion 21. A cementitious grout 30, or any other suitable self-setting composition, is then forced into the sleeve around the other bar 27. Where the bars are horizontal, the grout must be pastey or thixotropic, so as to remain in the sleeve whilst setting is occuring. When the grout has set, the gap between the two blocks of concrete 26 and 28 may be filled with concrete.

What we claim is:

1. A method of joining together two bodies of concrete, each body having therein a concrete-reinforcing bar, which method comprises compressing on to an end of the first of the bars a gripping portion of a metal sleeve so as to cause the gripping portion tightly to grip the bar, said metal sleeve also having an unpressed portion which, when the gripping portion of the metal sleeve grips the bar, extends beyond the end of the bar, said unpressed portion also having an internal diameter larger than the maximum cross-sectional dimension of the second of the bars, and securing an end of the second of the bars within the unpressed portion of the sleeve by means of a self-setting composition.

2. A method according to claim 1, in which the gripping portion of the sleeve is compressed on to the first bar before the respective body of concrete is cast about that bar.

3. A method according to claim 2, in which the concrete body in cast about the first bar such that, after casting of the concrete body, the sleeve opens at the adjacent face of the body.

4. A method according to claim 1, in which the two portions of the sleeve are releasably secured together.

5. A method according to claim 4, in which the two portions of the sleeve are provided with co-operable screw threads by means of which the two portions can be released one from the other.

6. A method according to claim 5, which comprises aligning the end of the second bar with the end of the first bar having the gripping portion of the sleeve compressed thereon, securing the unpressed portion to the gripping portion, the bars and the portions of the sleeve being arranged such that the unpressed portion surrounds the end of the second bar, inserting a self-setting composition into the unpressed portion, and allowing the composition to set to secure the bar therein.

7. A method according to claim 1, in which the self-setting composition is sufficiently thixotropic to remain in the unpressed portion of the sleeve while setting when that portion is horizontal.

8. A method according to claim 1, in which the self-setting composition is a shrink-resistant cemetitious or resinous composition.

9. A method according to claim 1, in which the unpressed portion of the sleeve is provided with internal deformations which form a key for the self-setting composition.

10. Two bodies of concrete, each body having therein concrete-reinforcing bar, joined together by means of a metal sleeve having a gripping portion and an unpressed portion, the gripping portion being compressed on to the end of one of the bars so as to grip the bar tightly, the unpressed portion extending beyond the end of the bar and having an internal diameter larger than the maximum cross-sectional dimension of the other of the bars, the end of the other bar being secured within the unpressed portion of the sleeve by means of a set self-setting composition.

* * * * *